US006752370B2

(12) United States Patent
Gonzales

(10) Patent No.: US 6,752,370 B2
(45) Date of Patent: Jun. 22, 2004

(54) CONCRETTE CURB FORM SPACER

(76) Inventor: Reyes Gonzales, 10285 N. Price, Fresno, CA (US) 93720

( * ) Notice: Subject to any disclaimer, the term of this patent is extended or adjusted under 35 U.S.C. 154(b) by 0 days.

(21) Appl. No.: 10/186,360

(22) Filed: Jun. 27, 2002

(65) Prior Publication Data

US 2003/0009897 A1 Jan. 16, 2003

Related U.S. Application Data

(60) Provisional application No. 60/304,732, filed on Jul. 10, 2001.

(51) Int. Cl.[7] ..... B32B 3/06

(52) U.S. Cl. ..... 249/205; 428/192; 33/371

(58) Field of Search ..... 428/192, 157; 299/2, 207, 205; D10/69; 33/371, 370, 613, 365, 645

(56) References Cited

U.S. PATENT DOCUMENTS 4,836,487 A 6/1989 Ringler
5,156,753 A 10/1992 Speidel
D354,218 S 1/1995 Van de Peer
D355,134 S 2/1995 Kennedy
5,761,874 A 6/1998 Hayakawa
5,937,604 A 8/1999 Bowron
6,083,584 A * 7/2000 Smith et al. ..... 428/192
D429,624 S 8/2000 Johnson
6,234,447 B1 5/2001 Boyden et al.

* cited by examiner

*Primary Examiner*—Alexander S. Thomas
(74) *Attorney, Agent, or Firm*—Mark D. Miller

(57) ABSTRACT

A method and apparatus for establishing and maintaining consistent spacing between parallel forms for concrete structures. The elongated spacer includes notches at either end for flush engagement with the upper corners of the parallel forms. An angled notch may be provided for engagement with angled toeboards used in curb construction, and a level may be included for use in setting the parallel forms at a consistent level.

11 Claims, 6 Drawing Sheets

CONCRETTE CURB FORM SPACER

This application claims the benefit of U.S. Provisional Application No. 60/304,732 filed on Jul. 10, 2001.

BACKGROUND OF THE INVENTION

1. Field of the Invention

The present invention relates to forming concrete, and more particularly to a unique form spreader for use in setting forms for concrete curbs, mow strips and the like.

2. Description of the Prior Art

Concrete curbs are formed using a pair of elongated panels or boards that must be set in position in parallel before the concrete slurry is poured between them. The parallel positioning requires that the panels or boards be separated by a consistent spacing, and that the tops of both panels or boards be at the same level. It is often difficult to maintain such consistency in the forms, especially over long distances. It is even more difficult with wider curbs such as mow strips.

The most common method for setting forms for concrete curbs is to excavate the area where the curb is to be installed, and then install two sets of linear boards in the area. The boards are placed end-to-end and turned on their sides to form a pair of parallel lines. The boards are held in place using a plurality of stakes that are driven into the ground using a hammer or other suitable means. A space is defined between the boards into which concrete will be poured to form the curb. The support stakes are installed on the outsides of the boards so as not to interfere with the formation of the concrete on the inside.

For most curbs, the parallel forms include a vertical backboard and an angled toeboard. The angled toeboard imparts an angle to the face of the final curb so that it is tapered, having a base that is wider than the top, facilitating better drainage. For curbs, the distance between the tops of the boards is typically six inches. For other installations such as mow strips, both boards are vertical, and the distance between them may vary from several inches to several feet. Whether the installation is a curb, mow strip or otherwise, it is important that the two lines formed by the boards be in parallel, that is, having a consistent space or distance between them. This assures that the curb or mow strip that is to be created will have a uniform thickness. Similarly, it is important that the tops of the boards of the forms be on the same level, assuring that the curb or mow strip that is formed will have a uniform height. These characteristics insure that the final concrete structure will have a neat and uniform appearance, as well as proper functionality.

Present methods for establishing a uniform distance between the parallel boards of a concrete curb form involve finding or cutting a scrap board, pipe or other object to the desired length, and using it as a spacer between the form boards as they are installed. In some cases a small level is taped or otherwise temporarily attached to the make-shift spacer for use in determining whether the tops of the form boards are level. The positions of the boards and the stakes holding them in place are adjusted using the make-shift spacer so that the boards are the same distance apart along the length of the form. Adjustments are accomplished by raising or lowering the form boards and stakes using a hammer or other suitable tool. Unfortunately, as the installation progresses, such make-shift spacers tend to drop, fall or otherwise become dislodged making it a cumbersome process to maintain uniform spacing between forms, particularly with the angled toeboards used for curbs. Often one worker must hold the such a spacer in place while another makes adjustments to the forms, or a single worker must devote one hand to holding such a spacer while trying to make adjustments with the other hand. As the spacing and height of the form board pairs are established along the route, it is typical to nail short planks across the tops of the pair of form boards at regular intervals to hold them together thereby maintaining these established distances. This is a labor intensive and inefficient process.

It is therefore desirable to provide a simple, reliable and efficient method and apparatus for use in establishing consistent spacing and leveling of forms for concrete curbs, mow strips and the like.

SUMMARY OF THE INVENTION

The present invention provides a method and apparatus for use in maintaining consistent spacing between linear parallel forms for concrete structures, and for use in keeping such forms at a consistent level. The apparatus of the invention is in the form of a spacer unit that extends from the top of the first form to the top of an adjacent parallel form. Orthogonal notches are cut out of the bottom corners of both ends of the spacer for engagement with the tops of both of the parallel forms. Consistent spacing is achieved by maintaining the forms at the distance between the notches on the spacer, in many cases by sliding the spacer along and between the forms. Because the notches of the spacer overlap onto the tops of the forms, it is unlikely that the spacer will become dislodged as the positions of the forms are adjusted.

The preferred embodiment of the spacer is designed for use during the installation of forms for concrete curbs. The 90-degree notch at one end of this spacer is orthogonal to the bottom of the spacer such that the upper surface of the notch is parallel to the bottom of the spacer, and the side surface of the notch is perpendicular to the bottom of the spacer. This first notch is designed to fit flush against the top and side surfaces (top corner) of the vertical backboard for the curb. However, the 90-degree notch at the other end of the spacer is established at an angle with respect to the bottom of the spacer such that the upper surface of this second notch is angled upward more than 90 degrees from the bottom of the spacer, and the side surface of this second notch is not perpendicular to the bottom of the spacer. This second notch is designed to fit flush against the top and side surfaces (top corner) of the angled toeboard for the curb. For convenience, the upper corner of the spacer above the second notch may be marked or beveled to indicate that the notch below it is the angled one.

In a simpler embodiment for use in forming mow strips and other similar structures having vertical forms, the 90-degree notches at both ends of the spacer are orthogonal to the bottom of the spacer such that the upper surfaces of both notches are parallel to the bottom of the spacer, and the side surfaces of both notches are perpendicular to the bottom of the spacer.

The spacer of each of the above embodiments may also be provided with at least one built-in level such as a bubble-level for use in determining whether the tops of the parallel forms are level with each other.

The spacing and leveling of linear forms is accomplished by using the spacer/leveler apparatus of the present invention as the forms are installed, and/or by adjusting the positions of the forms using the spacer/leveler apparatus following installation but prior to pouring concrete. A single spacer/leveler unit may be used to set or adjust a given set of parallel forms by traveling from one end of the linear forms to the other, making adjustments along the way. The notches at either end of the spacer fit flush against the top inside corners of the linear forms helping to establish uniform positioning and preventing the spacer from falling or becoming dislodged during adjustments to the forms. Alternatively, additional spacers, or spacer/levelers may be employed along sections of the parallel linear forms, particularly with forms covering long distances.

It is therefore a primary object of the present invention to provide an efficient and reliable method and apparatus for use in establishing a consistent distance between linear forms for concrete structures.

It is also a primary object of the present invention to provide a method and apparatus for use in setting linear forms for concrete structures at a consistent level.

It is also an important object of the present invention to provide an apparatus for use in setting level linear forms for concrete structures with consistent spacing that is not easily dislodged during installation or adjustments of the forms.

It is a further important object of the present invention to provide an apparatus for use in establishing and maintaining a given distance between linear forms for concrete curbs, mow strips and the like.

It is a further important object of the present invention to provide an apparatus for use in maintaining a consistent level between linear forms for concrete curbs, mow strips and the like.

It is a further important object of the present invention to provide an apparatus for the dual purpose of establishing and maintaining a given distance and level between linear forms for concrete curbs, mow strips and the like.

It is another object of the present invention to provide a method for establishing and maintaining distances and levels between linear forms for concrete structures.

It is another object of the invention to reduce the time and labor used to properly set parallel forms for concrete structures.

Other objects of the invention will be apparent from the detailed descriptions and the claims herein.

DETAILED DESCRIPTION OF A PREFERRED EMBODIMENT

Figure 1:
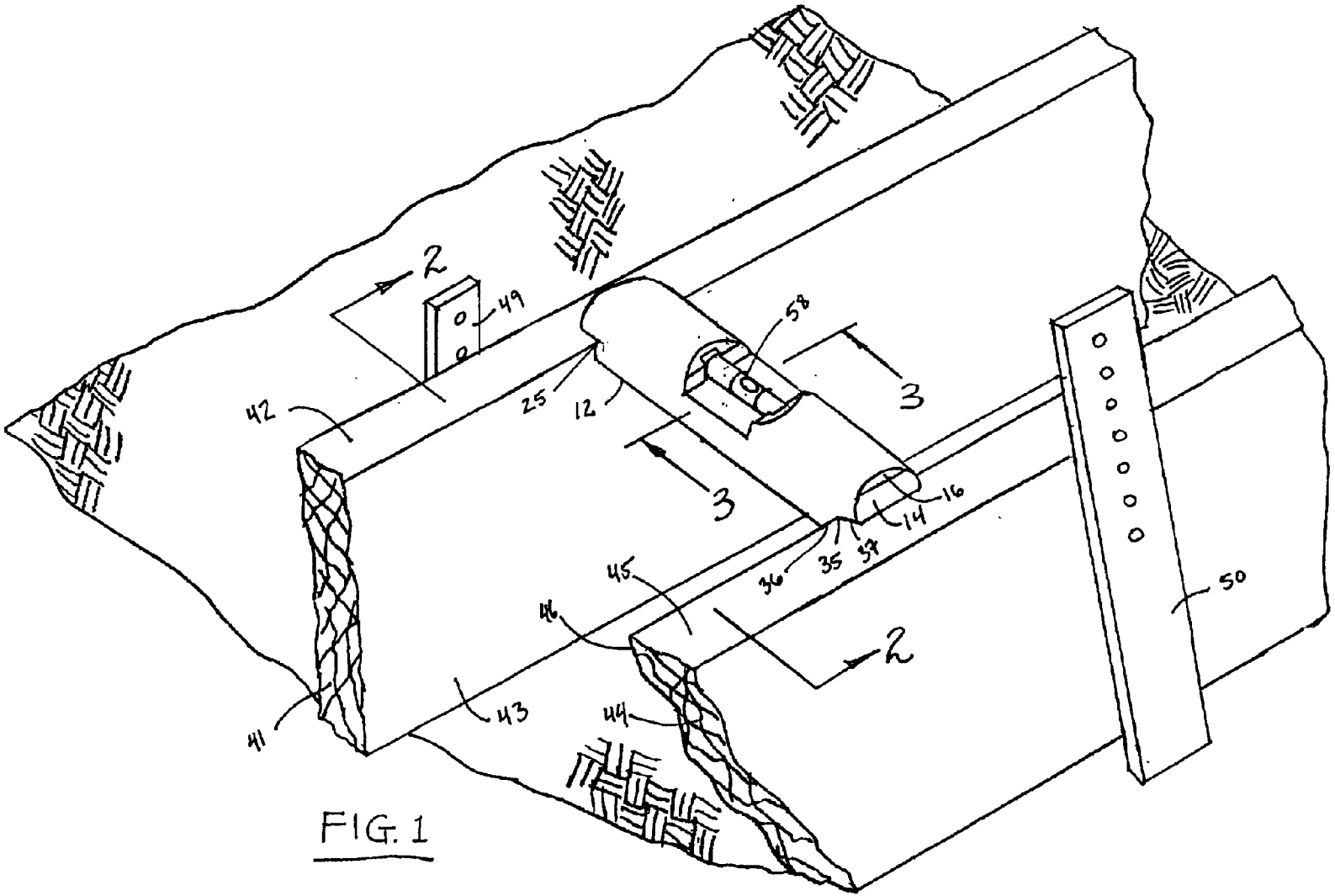
FIG. 1 is a perspective view of the present invention showing it in place between the tops of a pair of parallel linear concrete forms.
Figure 3:
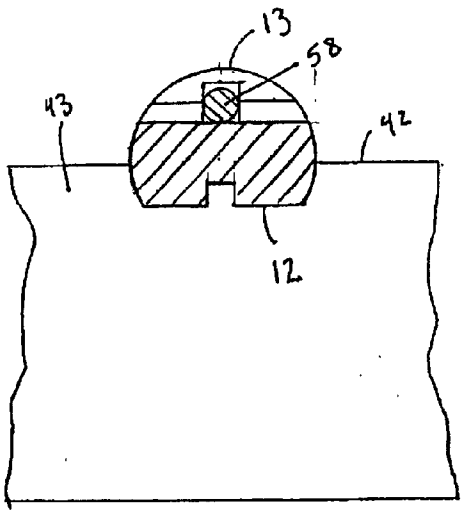
FIG. 3 is a sectional end view of the present invention along line 3—3 of FIG. 1.
Figure 2:
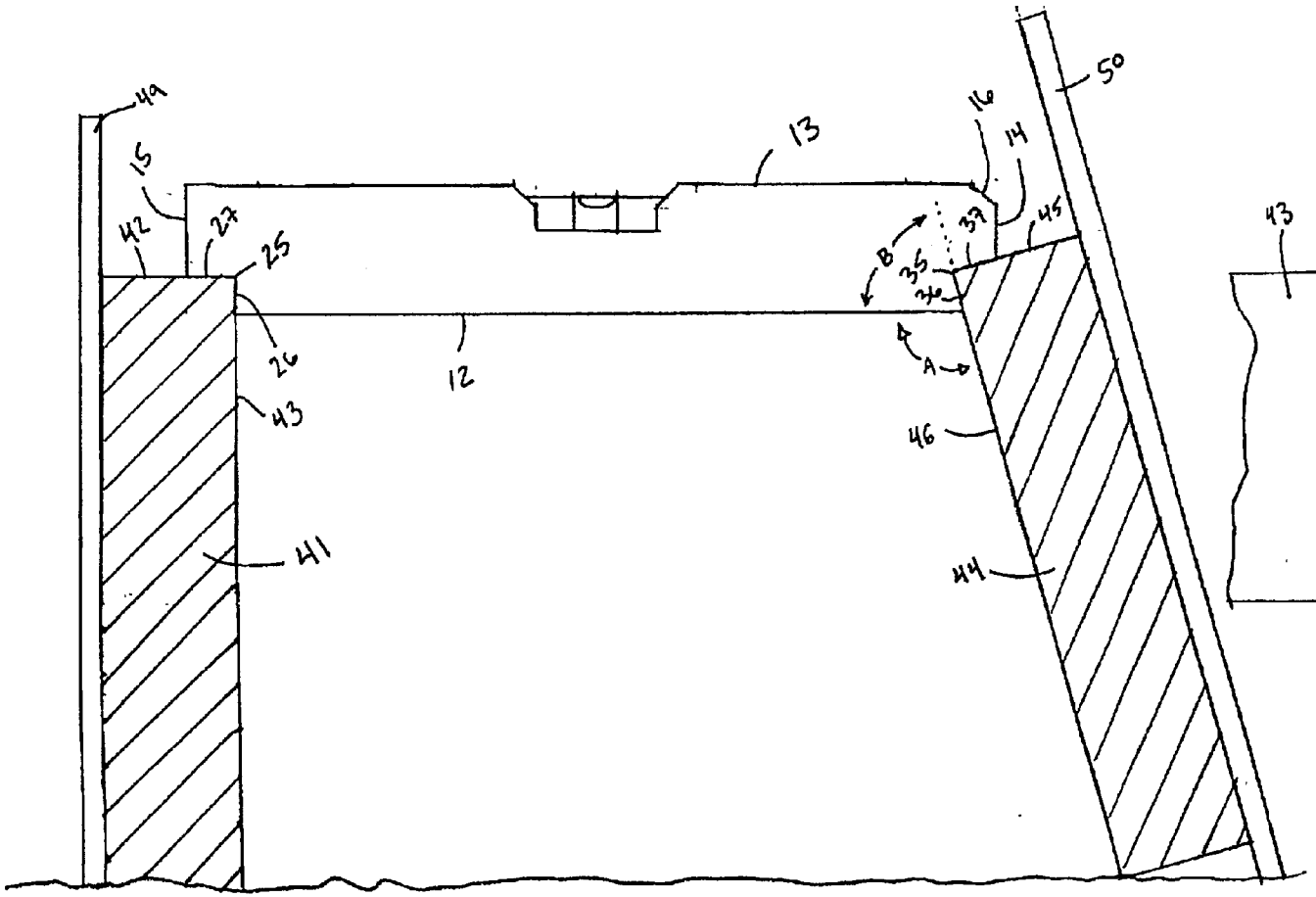
FIG. 2 is a sectional side view of the present invention along line 2—2 of FIG. 1.
Figure 4:
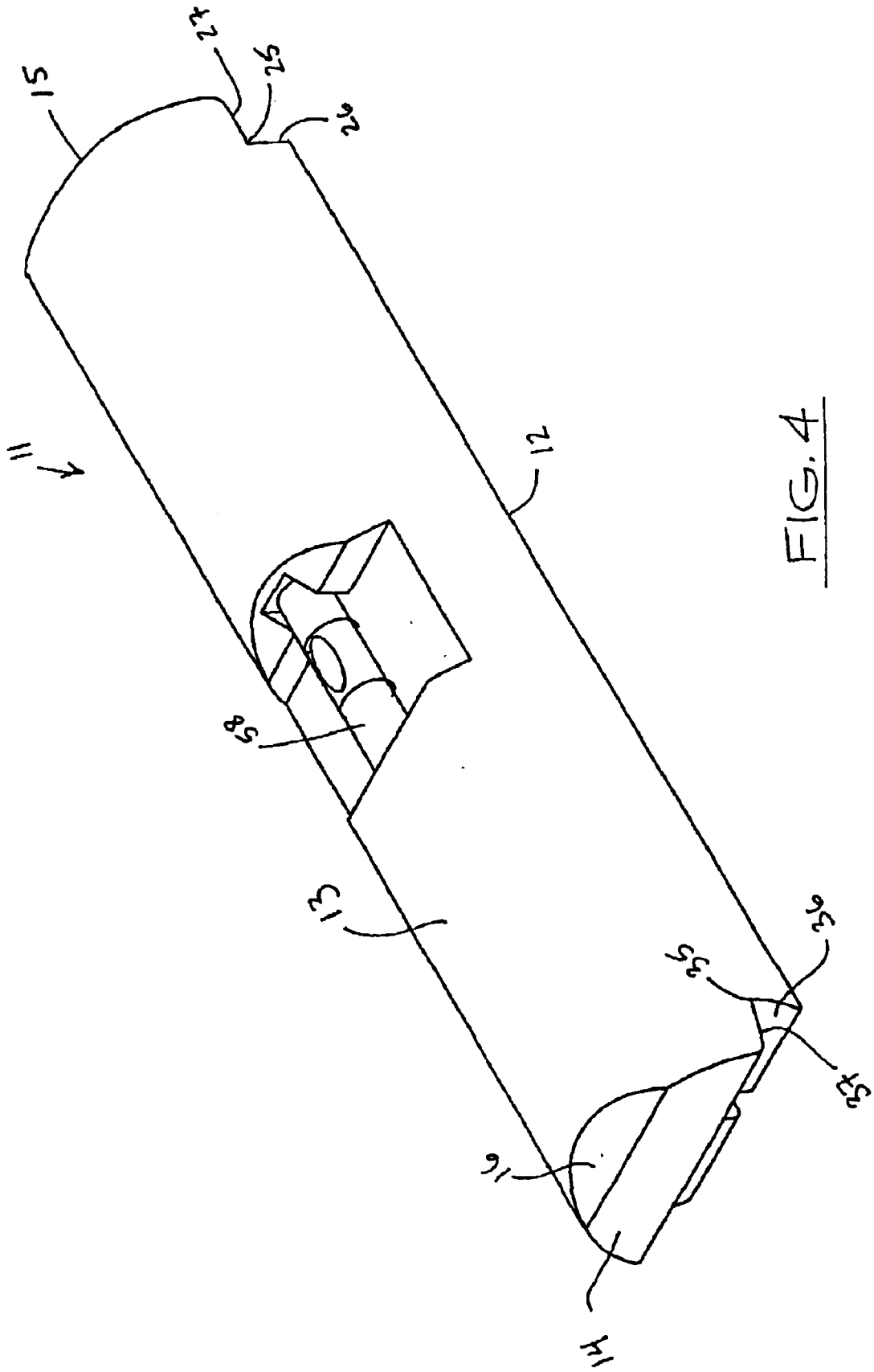
FIG. 4 is a perspective view of the present invention.

Referring to the drawings wherein like reference characters designate like or corresponding parts throughout the several views, and referring particularly to FIGS. 1–4 it is seen that the invention includes an elongated body member 11 having a flat bottom 12, a rounded top 13, a proximal end 14 and a distal end 15. Body member 11 is designed to bridge the gap between a pair of parallel linear form boards 41 and 44. Form board 41 illustrated in FIGS. 1 and 2 is in the form of a vertical backboard supported by stake 49, and form board 44 is in the form of an angled toeboard supported by angled stake 50 for establishing the face of a curb. In an alternative environment illustrated in FIG. 7, both boards 41 and 44 (and stakes 49, 50) are vertical.

Returning to FIGS. 1–4, a first orthogonal notch 25 is provided on the distal end 15 of body member 11 at the corner where bottom 12 meets end 15. Notch 25 includes a first surface 26 that is perpendicular to flat bottom 12, and a horizontal surface 27 that is perpendicular to first surface 26 and parallel with flat bottom 12. Notch 25 is designed for flush engagement with a vertically oriented form board 41 such that horizontal surface 27 fits flush against the flat upper edge 42 of board 41, and vertical surface 26 fits flush against the flat side surface 43 of board 41 as shown in FIGS. 1 and 2.

A second notch 35 is provided on the proximal end 14 of body member 11 at the corner where bottom 12 meets end 14. Notch 35 includes a first surface 36 that is at an acute angle B with respect to flat bottom 12, and a second surface 37 that is orthogonal and perpendicular to first surface 36, but which is also angled with respect to bottom 12 and end 14. Thus, second notch 35 is an orthogonal notch that is established at an angle with respect to bottom 12 and end 14. Angled notch 35 is designed for flush engagement with an angularly oriented form board 44 such that first surface 37 fits flush against the tilted flat upper edge 45 of board 44, and vertical surface 36 fits flush against the flat side surface 46 of board 44 as shown in FIGS. 1 and 2.

The length 12 of the bottom of spacer 11 between surfaces 26 and 36 is used to define the spacing between the tops of forms 41 and 44. By moving or sliding the spacer 11 along forms 41 and 44, the user can determine what adjustments must be made to the positions of the forms to make them fit flush with the notches 25, 35 in the spacer, thereby establishing a consistent distance 12 between the forms along their length. Spacer 11 may be of any desired length from as short as just a few inches to as long as several feet establishing a corresponding spacing distance 12, according to the desired distance to be established between forms 41 and 44.

In the preferred embodiment, a level 58 is built into spacer body 11 as shown in FIGS. 1–7. However, the level 58 may be eliminated as shown in FIG. 8. When the spacer 11 is placed between forms 41 and 44, level 58 may be used to confirm whether the tops of the forms are level. Adjustments may be made to either form 41 or 44 to bring them level with each other.

A bevel 16 or other suitable mark or indicia may be provided on the proximal end 14 to indicate that this is the end of the device (14) where the angled notch 35 is located. Mark 16 makes it easy for the user to determine from above which end (15) of spacer 11 should be placed adjacent to the vertical backboard 41 and which end (14) should be placed against angled toeboard 44.

Figure 5:
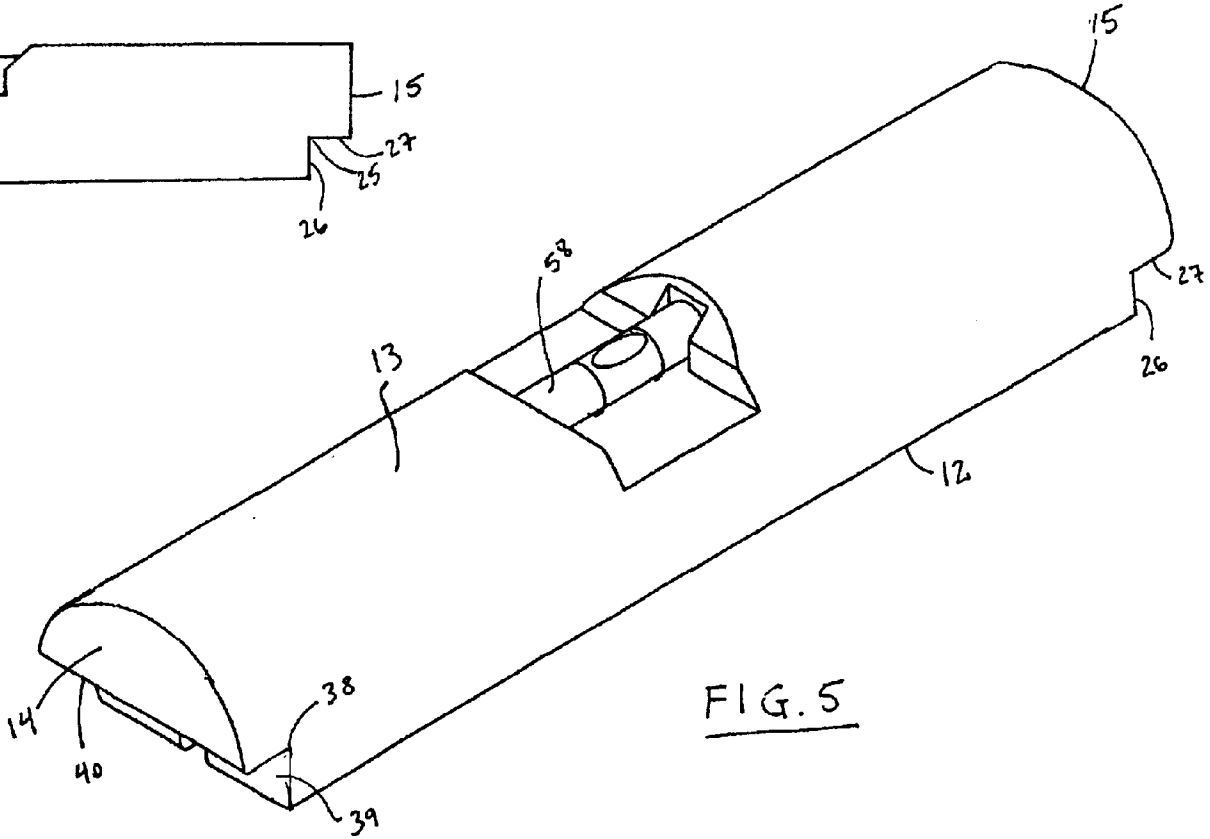
FIG. 5 is a perspective view of an alternative embodiment of the present invention.
Figure 6:
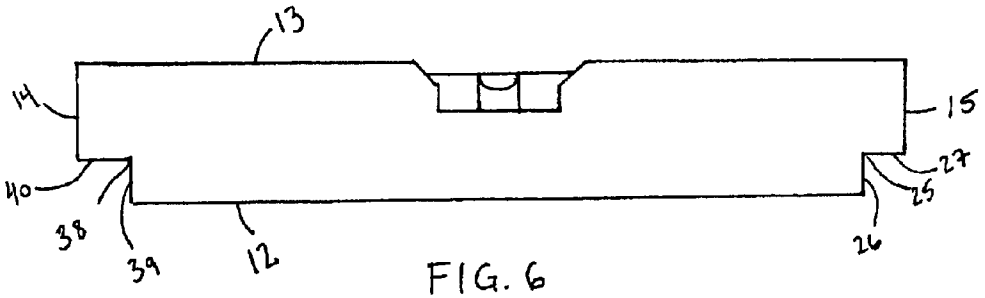
FIG. 6 is a side view of the alternate embodiment of FIG. 5.
Figure 7:
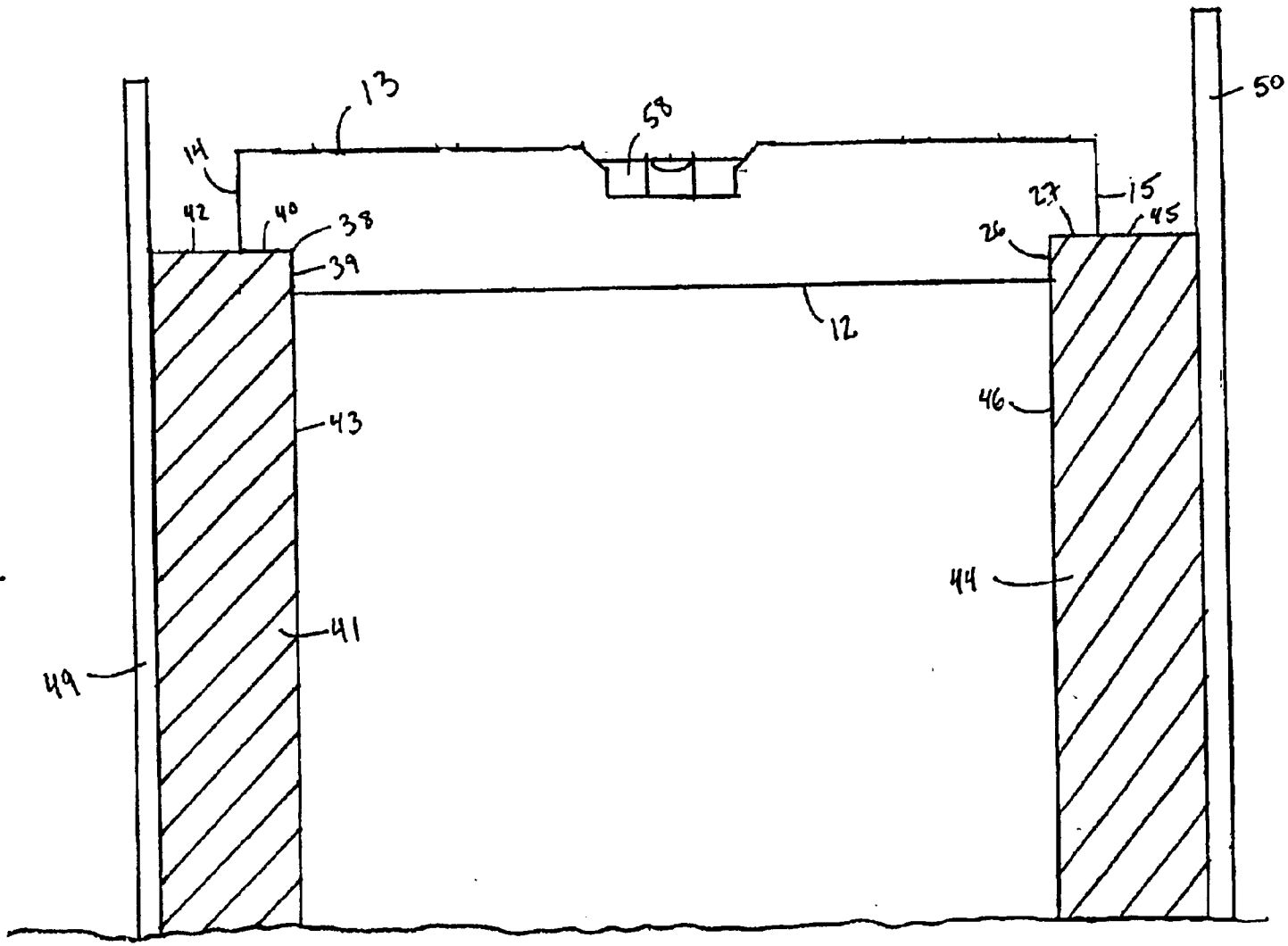
FIG. 7 is a sectional side view of the alternate embodiment of FIGS. 5 and 6 in place on a pair of vertical forms.
Figure 8:
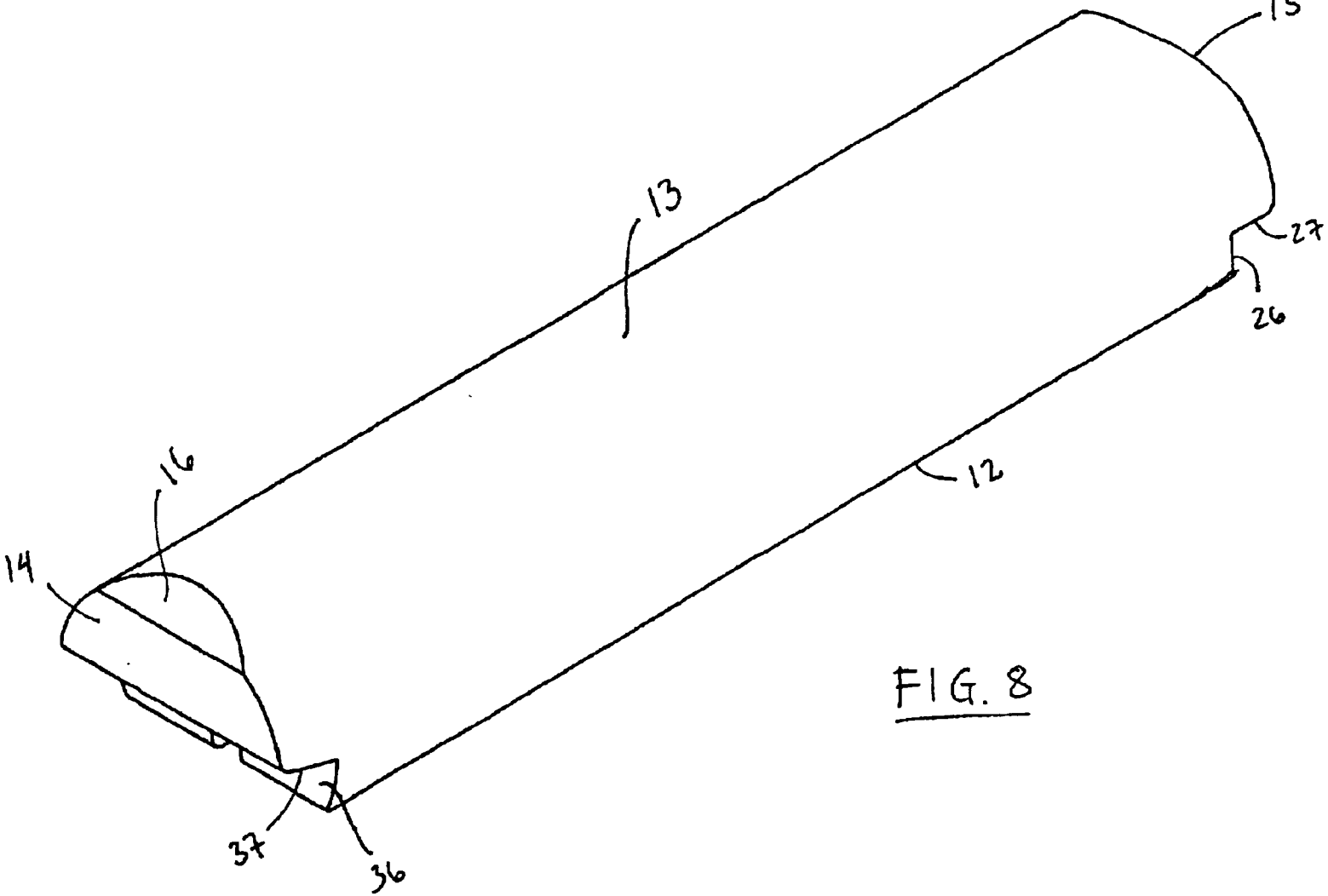
FIG. 8 is a perspective view of another alternative embodiment of the present invention.
Figure 1:
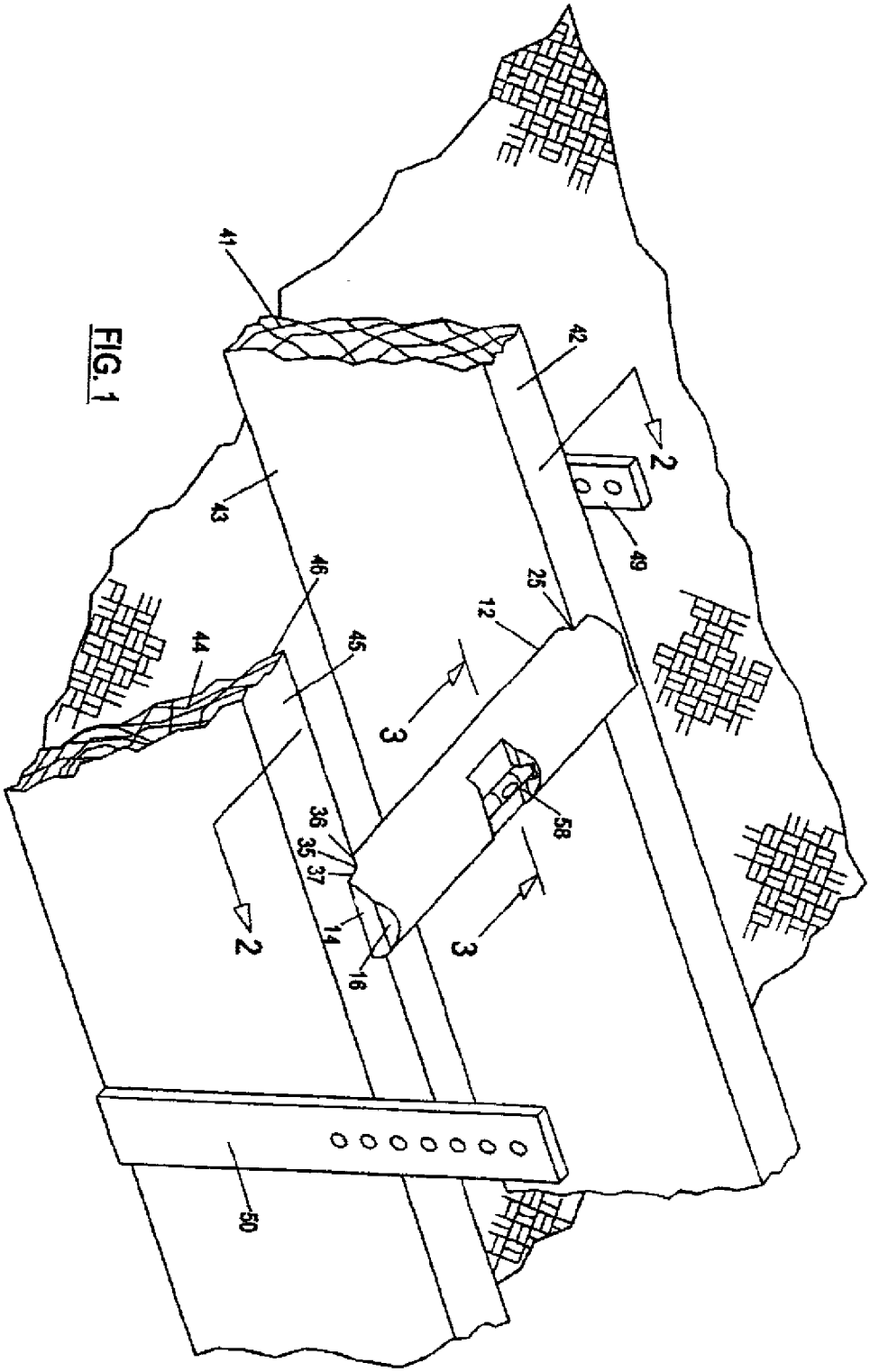
Figure 2:
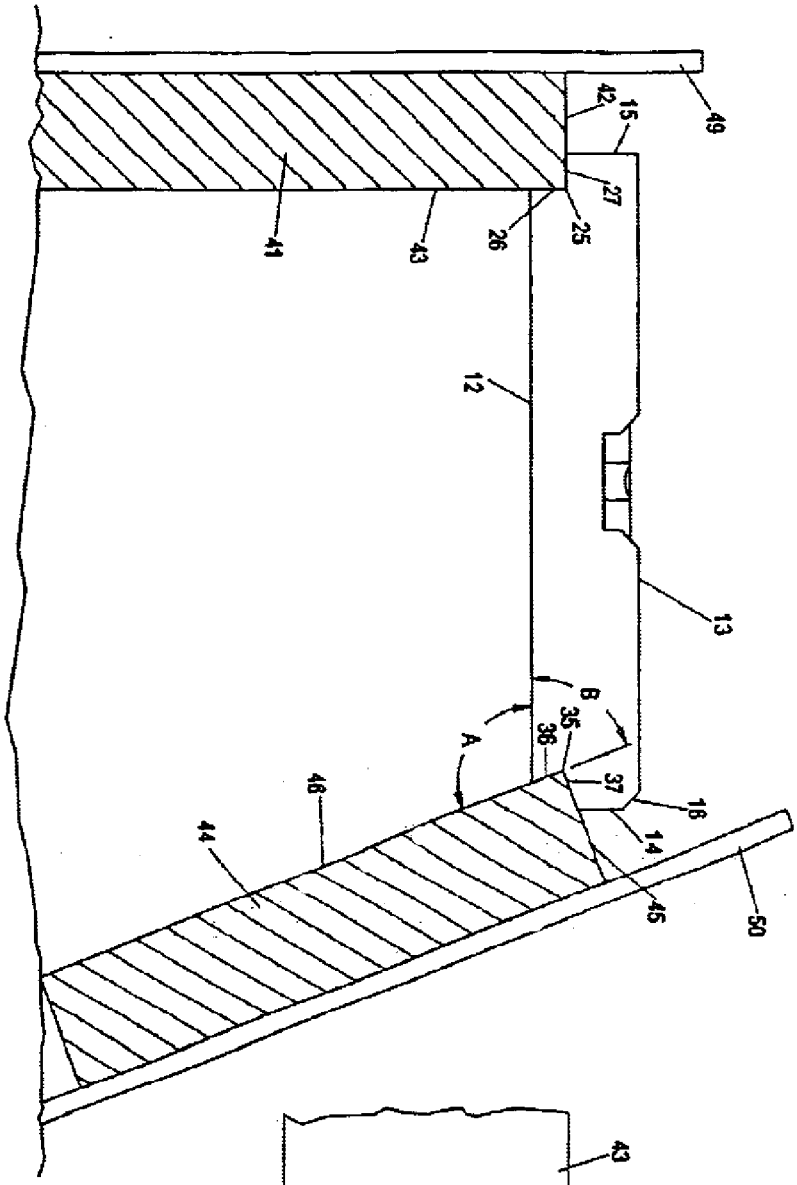
Figure 3:
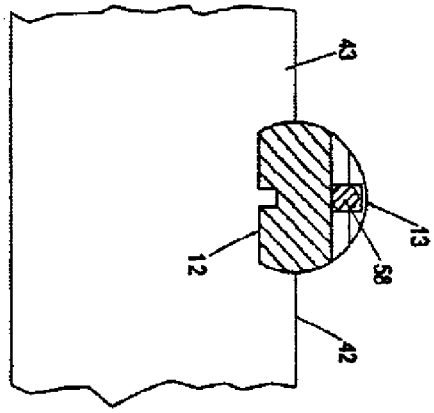
Figure 4:
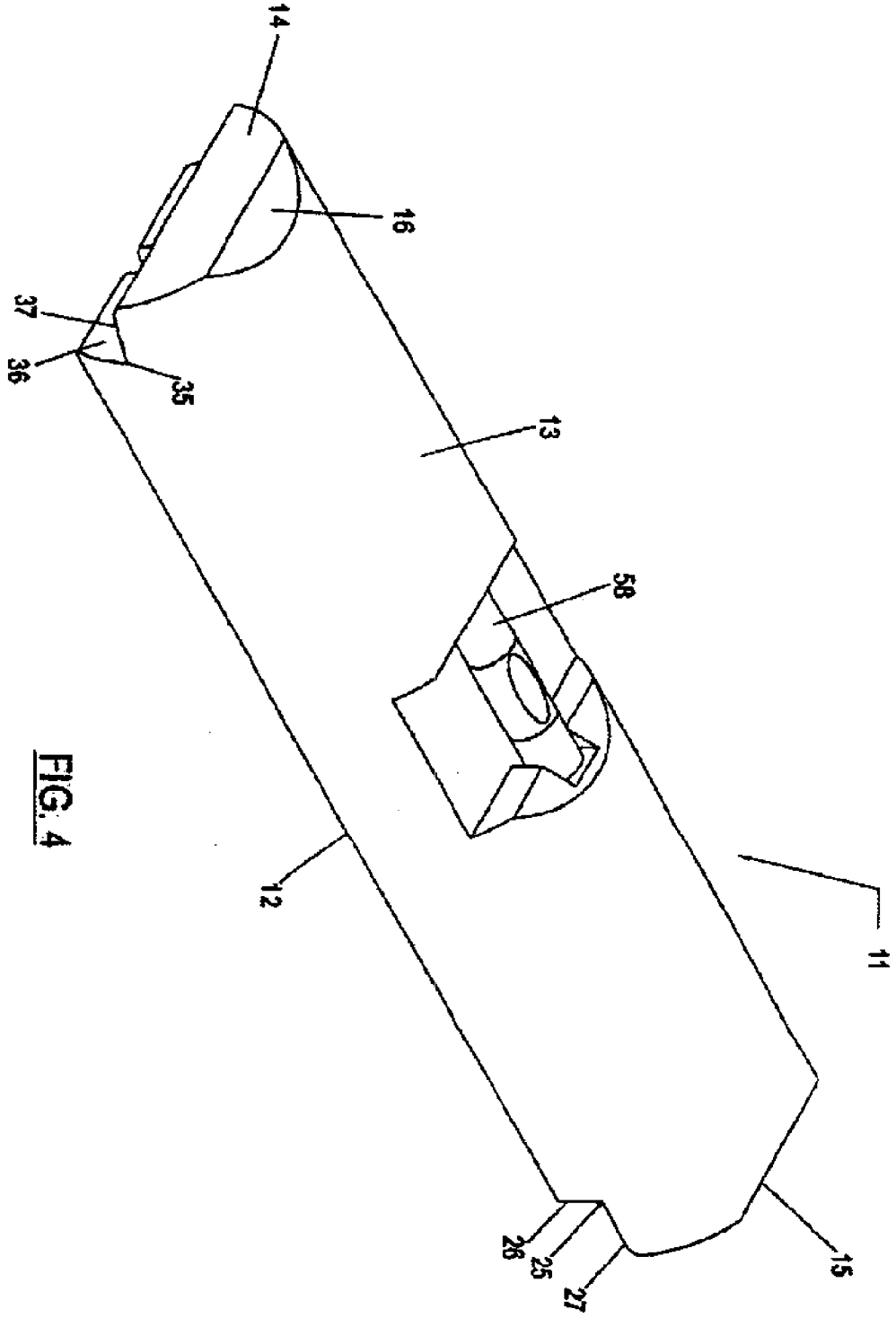
Figure 6:
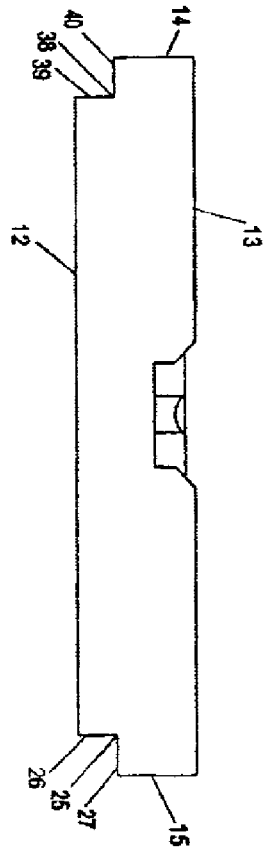
Figure 5:
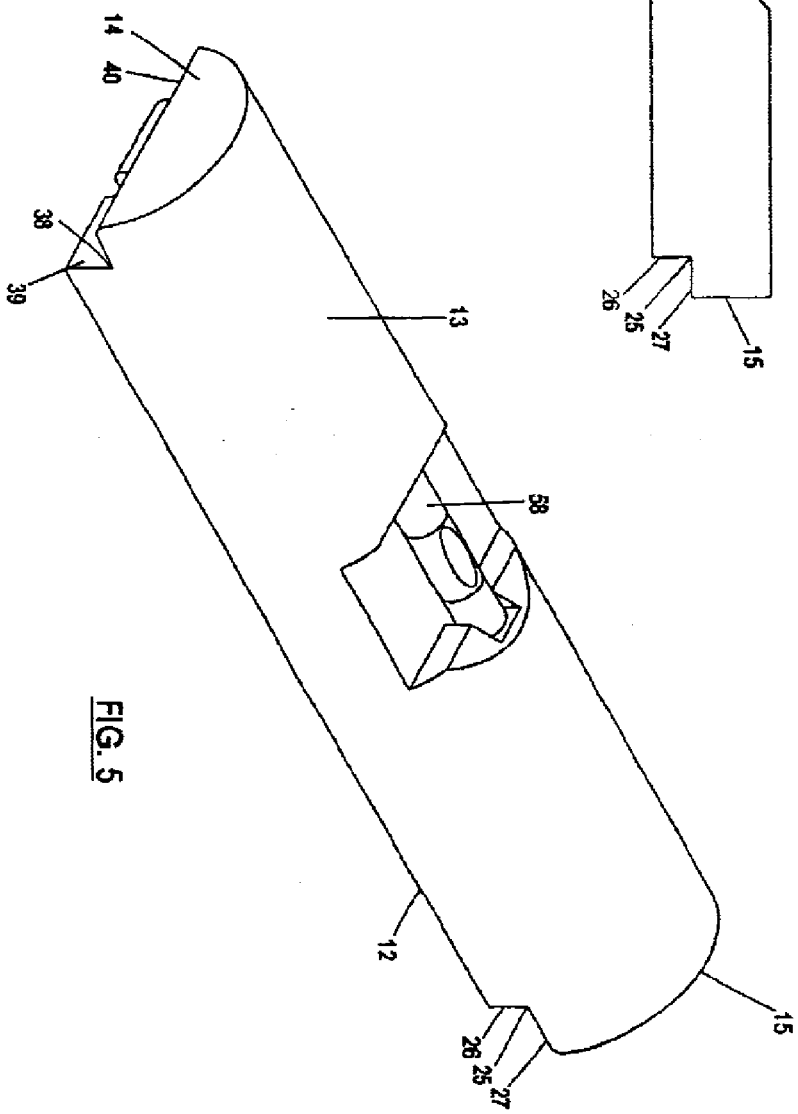
Figure 7:
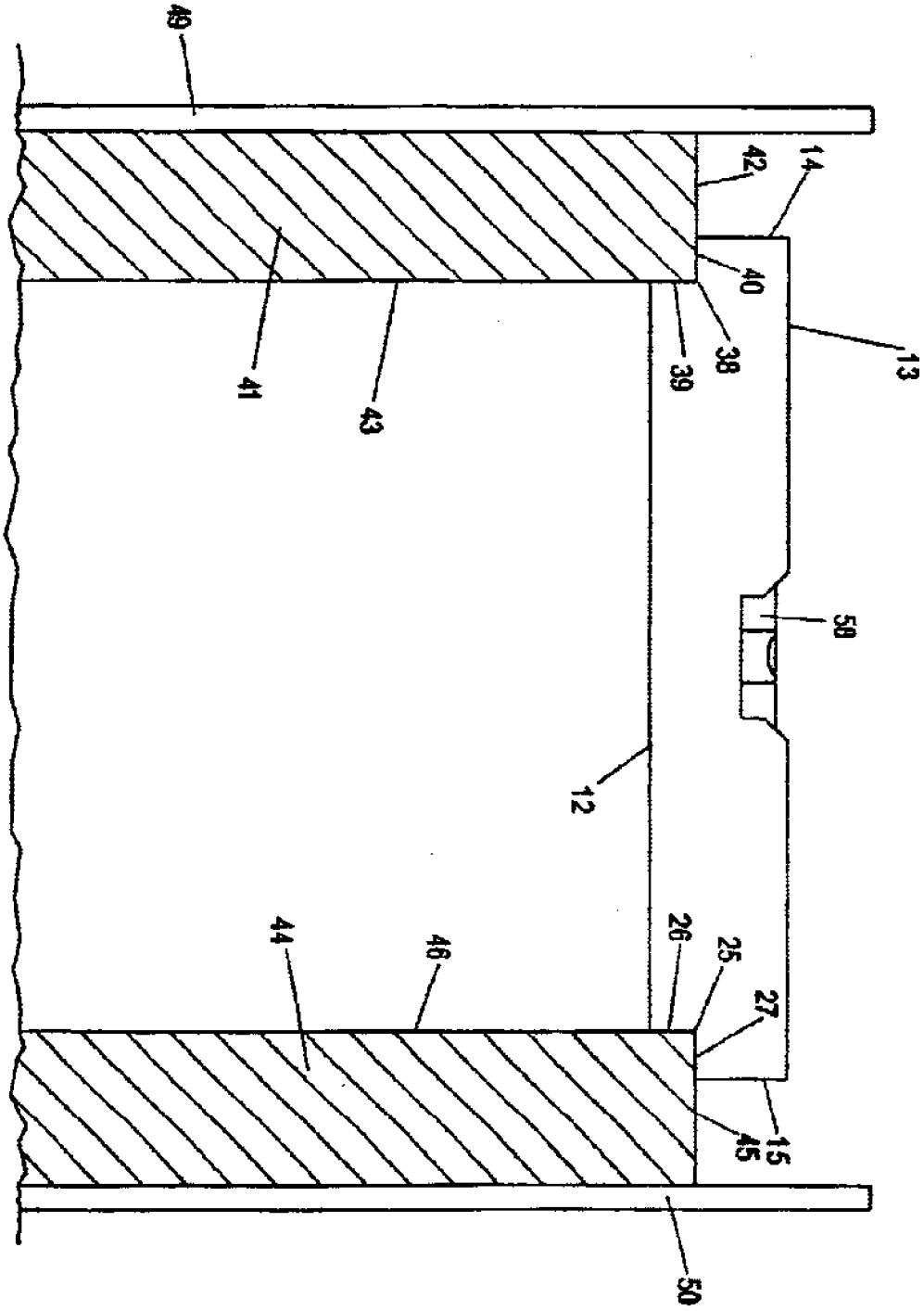
Figure 8:
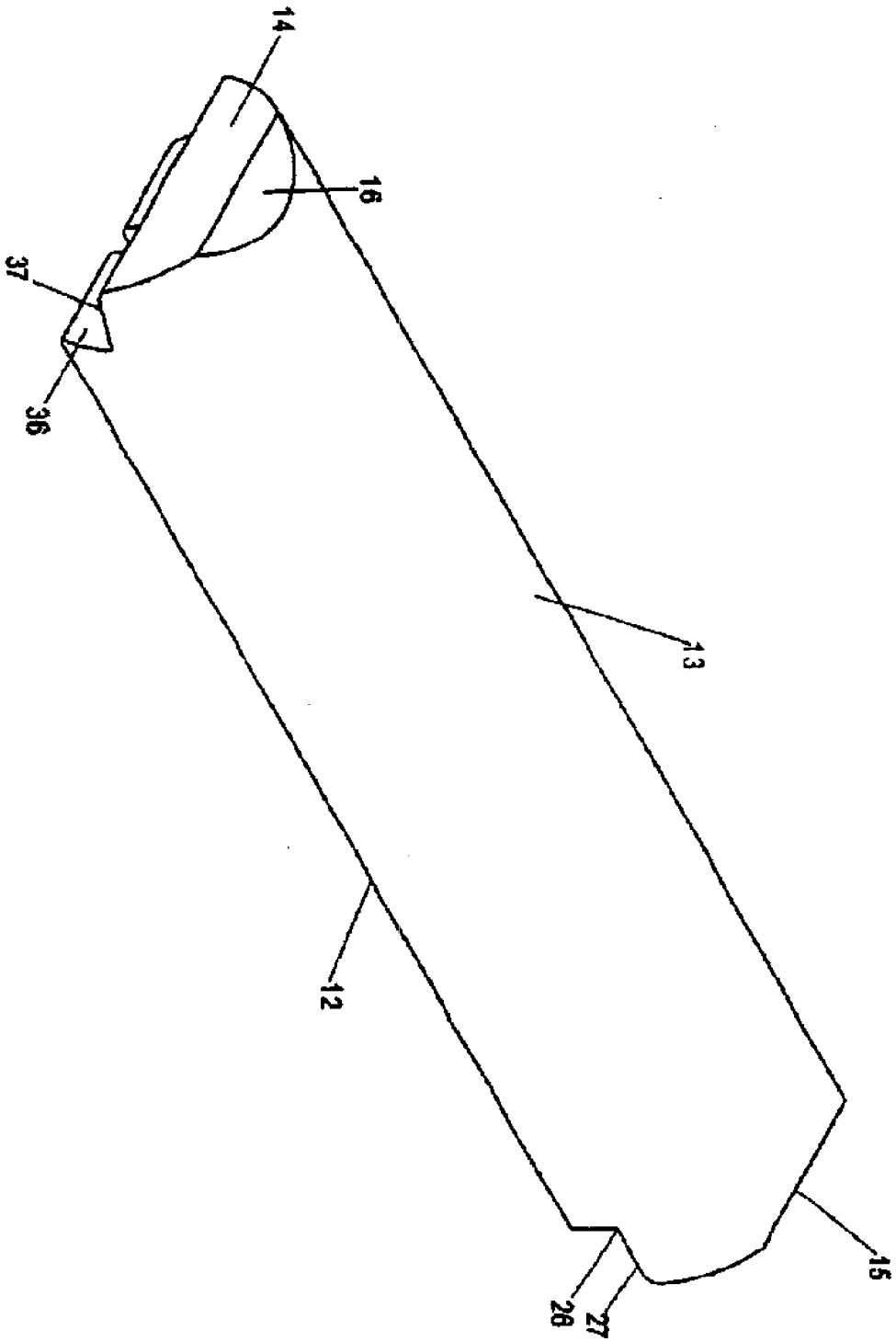

In a simpler embodiment of the invention shown in FIGS. 5–7, the notches at both ends are perpendicular to flat bottom 12. Thus, a notch 38 with orthogonal surfaces 39 and 40 is provided at proximal end 14, defining a mirror image of notch 25 at distal end 15. The simpler embodiment has no mark or bevel 16 at either end, and is used for spacing pairs of vertically oriented form boards such as those used to form mow strips and the like as shown in FIG. 7. A level may also be employed in this embodiment to level the tops of the form boards.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

What is claimed is:

1. A concrete form spacer comprising an elongated solid body member in the form of a rod having a top, a flat bottom, and a pair of ends, each of said ends having a notch provided therein at the corner where said end meets said bottom, each such notch being orthogonal to said flat bottom and each notch having an orthogonal cross section extending across said entire respective corner for temporary engagement with a pair of generally parallel linear forms for establishing consistent spacing between said forms when said spacer is placed therebetween.

2. A concrete form spacer comprising an elongated body member having a top, a flat bottom, and a pair of ends, each of said ends having a notch provided therein at the corner where said end meets said bottom, each notch having an orthogonal cross section for temporary engagement with a pair of generally parallel linear forms for establishing consistent spacing between said forms, wherein one of said notches is orthogonal to said flat bottom and the other of said notches is established at an acute angle with respect to the bottom of said spacer.

3. The spacer of claim 2 wherein a level is built into said body member.

4. The spacer of claim 2 wherein a mark is provided on the top of said spacer at the end where said acutely angled notch is located.

5. A spacer for use in establishing a consistent distance between pairs of parallel forms used to form concrete curbs comprising an elongated body member having a top, a flat bottom, a proximal end forming a first corner with said bottom, and a distal end forming a second corner with said bottom, a first notch provided at said first corner orthogonal to said bottom, and a second notch provided at said second corner at an acute angle relative to said bottom, such that said first notch fits flush against a vertically oriented form and said second notch fits flush against an angularly oriented form.

6. The spacer of claim 5 wherein a mark is provided on the top of said spacer at said distal end for identifying said angled second notch.

7. The spacer of claim 6 wherein a level is built into said body member.

8. A method for establishing a consistent distance between pairs of parallel forms for use in forming concrete structures comprising the steps of:

a. erecting a pair of parallel linear forms;

temporarily placing a spacer on top of and between said forms, said spacer comprising an elongated body member having a top, a flat bottom, and a pair of ends, each of said ends having a notch provided therein at the corner where said end meets said bottom, each such notch being orthogonal to said flat bottom and each notch having an orthogonal cross section, such that one of said notches engages an upper inside corner of one of said forms, and the other of said notches engages an upper inside corner of the other of said forms;

c. moving said spacer along said linear forms from their beginning to their end;

d. adjusting the positions of said forms as said spacer is moved so that the inside corners of said forms are flush with the notches of said spacer along the length of said forms; and e. removing said spacer.

9. The method of claim 8 wherein said spacer includes a level and including the additional step of adjusting the level of said forms as said spacer is moved along their length.

10. A concrete form spacer comprising an elongated body member having a top, a flat bottom, and a pair of ends, each of said ends having a notch provided therein at the corner where said end meets said bottom, each such notch having an orthogonal cross section extending across said entire respective corner for temporary engagement with one of a pair of generally parallel linear forms for establishing consistent spacing between said forms wherein at least one of such notches is orthogonal to said flat bottom.

11. The spacer of claim 10 wherein at least one of such notches is provided at an acute angle relative to said bottom.

* * * * *

UNITED STATES PATENT AND TRADEMARK OFFICE

CERTIFICATE OF CORRECTION

PATENT NO. : 6,752,370 B2
DATED : June 22, 2004
INVENTOR(S) : Reyes Gonzales

It is certified that error appears in the above-identified patent and that said Letters Patent is hereby corrected as shown below:

Title page, Item [54] and Column 1, line 1,
Title, replace "CONCRETTE" with -- CONCRETE --

Title page,
Drawing, replace drawing with final Figure 1

Drawings,
Figures 1, 2, 3, 4, 5, 6 and 7, replace with the final Figures 1, 2, 3, 4, 5, 6 and 7

Column 2,
Line 1, delete "the"

Signed and Sealed this

Twenty-first Day of December, 2004

JON W. DUDAS
*Director of the United States Patent and Trademark Office*